US011786102B2

(12) United States Patent
Martinez et al.

(10) Patent No.: US 11,786,102 B2
(45) Date of Patent: Oct. 17, 2023

(54) BULK DETERGENT DISPENSER AND DISHWASHER INCLUDING A BULK DETERGENT DISPENSER

(71) Applicant: Haier US Appliance Solutions, Inc., Wilmington, DE (US)

(72) Inventors: Monica Martinez, Louisville, KY (US); Rose Marie Connelly, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/471,286

(22) Filed: Sep. 10, 2021

(65) Prior Publication Data

US 2023/0079570 A1 Mar. 16, 2023

(51) Int. Cl.
*A47L 15/44* (2006.01)
*A47L 15/00* (2006.01)

(52) U.S. Cl.
CPC ..... *A47L 15/4418* (2013.01); *A47L 15/0055* (2013.01)

(58) Field of Classification Search
None
See application file for complete search history.

(56) References Cited

U.S. PATENT DOCUMENTS

| | | | | |
|---|---|---|---|---|
| 6,231,085 | B1 * | 5/2001 | Olson | F16L 33/24 29/451 |
| 6,874,656 | B2 | 4/2005 | Rohr | |
| 7,275,552 | B2 | 10/2007 | Borah | |
| 7,284,561 | B2 | 10/2007 | Byrne | |
| 7,464,718 | B2 | 12/2008 | James | |
| 7,931,032 | B1 | 4/2011 | Noa, Jr. | |
| 8,210,188 | B2 | 7/2012 | Allen | |
| 2006/0059958 | A1 | 3/2006 | Kurt, Sr. | |

FOREIGN PATENT DOCUMENTS

EP 3072433 A1 9/2016

* cited by examiner

*Primary Examiner* — Rita P Adhlakha
(74) *Attorney, Agent, or Firm* — Dority & Manning, P.A.

(57) ABSTRACT

A dishwashing appliance includes a tub defining a wash chamber for receipt of articles for washing, the tub including a plurality of sidewalls; a door movable between a closed position and an open position, the door comprising an inner panel enclosing the wash chamber when the door is in the closed position; and a dispenser assembly mounted to the inner panel. The dispenser assembly includes a door box including a pump chamber, the pump chamber defining an inlet hole and an outlet hole; a tunnel piece extending from the pump chamber; a bottle removably coupled to the tunnel piece; and a cap connected to the bottle, wherein the cap is configured to receive at least a portion of the tunnel piece therethrough.

13 Claims, 8 Drawing Sheets

BULK DETERGENT DISPENSER AND DISHWASHER INCLUDING A BULK DETERGENT DISPENSER

FIELD OF THE INVENTION

The present subject matter relates generally to dishwashing appliances, and more particularly to dispenser assemblies mounted thereon to supply a wash additive to a dishwashing appliance.

BACKGROUND OF THE INVENTION

Dishwashers or dishwashing appliances generally include a tub that defines a wash compartment. Rack assemblies can be mounted within the wash compartment of the tub for receipt of articles for washing. In a typically known dishwashing appliance, spray assemblies within the wash compartment can apply or direct wash fluid towards articles disposed within the rack assemblies in order to clean such articles. Multiple spray assemblies can be provided including, for example, a lower spray arm assembly mounted to the tub at a bottom of the wash compartment, a mid-level spray arm assembly mounted to one of the rack assemblies, or an upper spray assembly mounted to the tub at a top of the wash compartment.

In order to facilitate cleaning of articles in a dishwashing appliance, cleaning agents or wash additives are used. During operation of the dishwashing appliance, the wash additives generally mix with water in the wash compartment to form a fluid that is used to clean articles within the wash compartment. Wash additives include, for example, detergents and rinse agents. In some cases, liquid wash additives are used.

For some existing appliances, wash additives are stored in one or more reservoirs defined in the doors of dishwashing appliances and are dispensed from these reservoirs during operation of the dishwashing appliance. In many of these existing appliances, the reservoir(s) are generally provided as elements that defined in the door. As an example, one or more pockets can be defined in the door to store additives such as liquids, powders, or the like. These existing designs come with various drawbacks. For instance, a user must refill the reservoir(s) for each dishwashing operation, requiring time and effort.

As a result, it would be useful to provide a dishwasher appliance or dispenser assembly having features to address one or more of the above issues. In particular, it would be advantageous to provide an easily attachable dispensing assembly provided within the dishwasher appliance. Additionally or alternatively, it would advantageous to provide a dishwasher door and dispensing assembly including bulk storage of wash additive capable of being attached together without requiring specialized tools while still ensuring a water-tight seal.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwashing appliance is provided. The dishwashing appliance may define an axial direction, a radial direction, and a circumferential direction. The dishwashing appliance may include a tub defining a wash chamber for receipt of articles for washing; a door movable between a closed position and an open position; and a dispenser assembly mounted to the door. The dispenser assembly may include an adapter mounted to the door, the adapter including an inlet boss configured to engage a spout of a detergent bottle and a discharge barb opposite the inlet boss, wherein the inlet boss is configured to deflect a cap seal of the detergent bottle; and a pump fluidly coupled to the discharge barb of the adapter for selectively urging a flow of detergent from the detergent bottle.

In another exemplary aspect of the present disclosure, a detergent assembly is provided. The detergent assembly may define an axial direction, a radial direction, and a circumferential direction. The detergent assembly may include a box frame including a pump chamber, the pump chamber defining an inlet hole and an outlet hole; an adapter extending from the pump chamber, the adapter including an inlet boss and a discharge barb opposite the inlet boss; a bottle removably coupled to the adapter; and a cap connected to the bottle, wherein the cap is configured to receive the inlet boss of the adapter therethrough.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
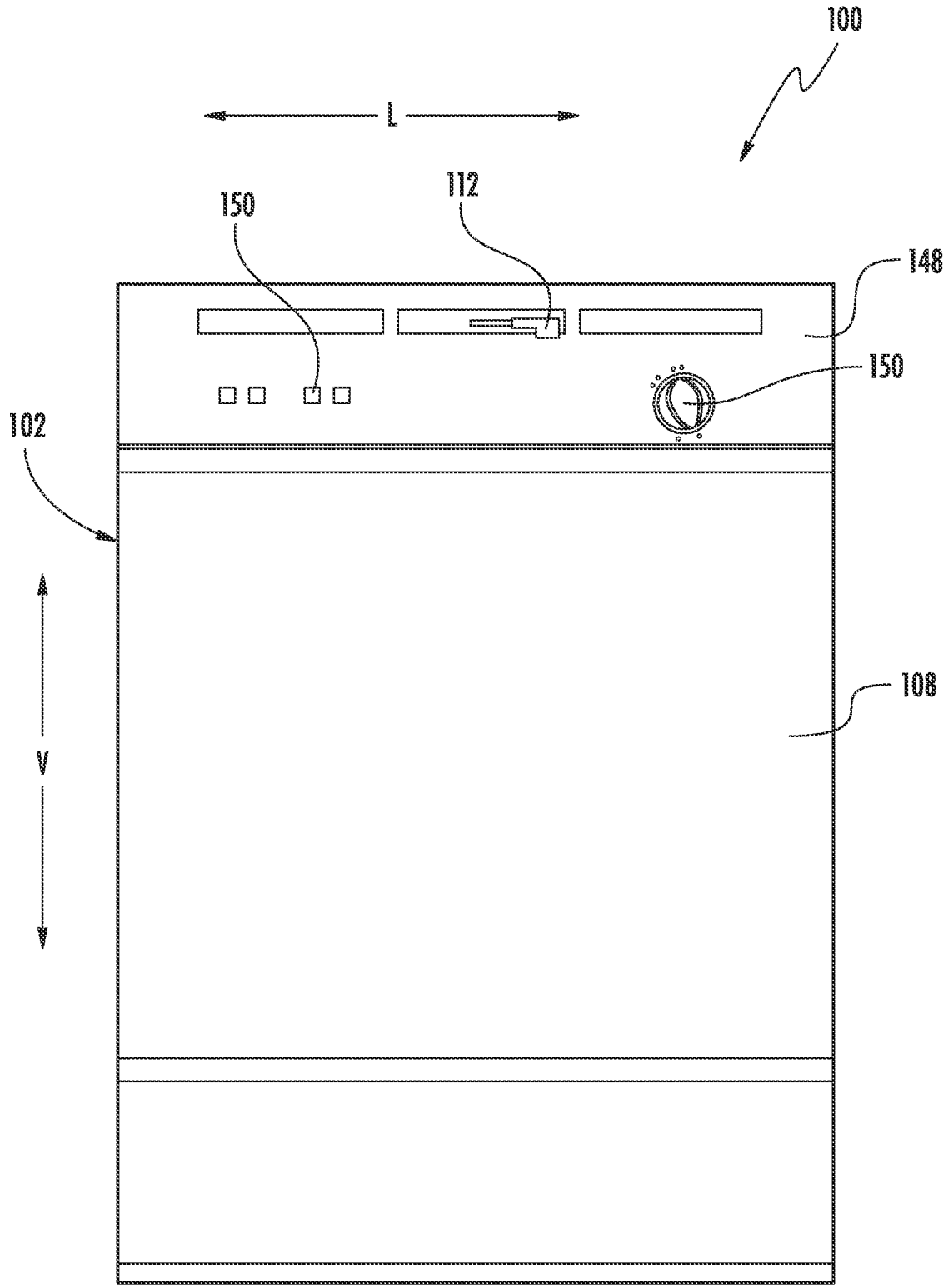
FIG. 1 provides a front elevation view of an exemplary dishwashing appliance according to one or more embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one element from another and are not intended to signify location or importance of the individual elements.

Figure 2:
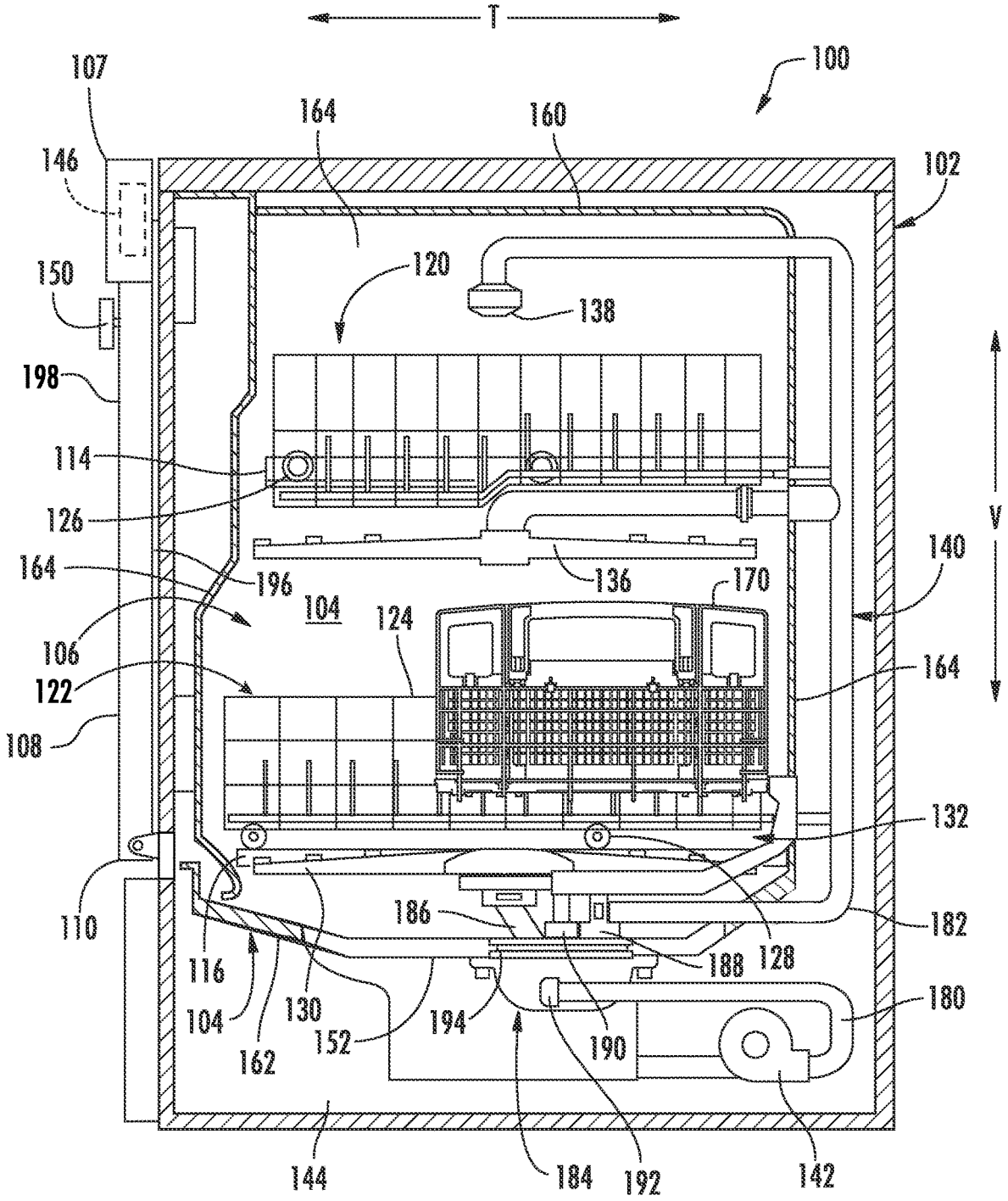
FIG. 2 provides a side, section view of the exemplary dishwashing appliance of FIG. 1.

Turning now to the figures, FIGS. 1 and 2 illustrate a domestic dishwashing appliance 100 according to exemplary embodiments of the present disclosure. As shown in FIGS. 1 and 2, the dishwashing appliance 100 may include a cabinet 102 having a tub 104 therein defining a wash chamber 106. The tub 104 may generally include a front opening and a door 108 hinged at its bottom 110 for rotatable movement between a closed or vertical position (shown in FIGS. 1 and 2), wherein wash chamber 106 is sealed shut for washing operation and access to wash chamber 106 is restricted, and a horizontal open position for loading and unloading of articles from the dishwashing appliance 100. As shown in FIG. 1, a latch 112 may be used to lock and unlock the door 108 for access to the chamber 106.

Generally, cabinet 102 may define a discrete vertical direction V, lateral direction L, and transverse direction T. Vertical direction V, lateral direction L, and transverse direction T are mutually perpendicular such that vertical direction V, lateral direction L, and transverse direction T form an orthogonal directional system.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., three sidewalls) extending between the top and bottom walls 160, 162. It should be appreciated that the tub 104 may generally be formed from any suitable material. However, in optional embodiments, the tub 104 may be formed from a ferritic material, such as stainless steel, or a polymeric material.

As particularly shown in FIG. 2, upper and lower guide rails 114, 116 may be mounted on opposing sidewalls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack 120, 122 is substantially positioned outside wash chamber 106, and a retracted position (shown in FIGS. 1 and 2) in which the rack 120, 122 is located inside wash chamber 106. This may be facilitated by rollers 126 and 128, for example, mounted onto racks 120 and 122, respectively.

In some embodiments, a silverware basket 170 is removably mounted to lower rack assembly 122. However, in alternative exemplary embodiments, the silverware basket 170 may also be selectively attached to other portions of dishwashing appliance 100 (e.g., door 108). The silverware basket 170 defines one or more storage chambers and is generally configured to receive silverware, flatware, utensils, and the like, that are too small to be accommodated by the upper and lower rack assemblies 120, 122. The silverware basket 170 may be constructed of any suitable material (e.g., metal or plastic) and define a plurality of fluid slots for permitting wash fluid therethrough.

The dishwashing appliance 100 includes one or more spray assemblies housed within wash chamber 106. For instance, the dishwashing appliance 100 may include a lower spray-arm assembly 130 that is rotatably mounted within a lower region 132 of wash chamber 106 directly above the bottom wall 162 of the tub 104 so as to rotate in relatively close proximity to the rack assembly 122. As shown in FIG. 2, a mid-level spray-arm assembly 136 may be located in an upper region of wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating fluid (e.g., water and dishwasher fluid) within the tub 104. As shown in FIG. 2, the fluid circulation assembly 140 may also include a pump 142 located in a machinery compartment 144 located below the bottom wall 162 of the tub 104. One or all of the spray assemblies 130, 136, 138 may be in fluid communication with the pump 142 (e.g., to receive a pressurized wash fluid therefrom). Additionally, each spray-arm assembly 130, 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of the lower spray-arm assembly 130 provides coverage of dishes and other dishwasher contents with a spray (e.g., a spray of washing fluid).

It should be appreciated that, although the dishwashing appliance 100 will generally be described herein as including three spray assemblies 130, 136, 138, the dishwashing appliance may, in alternative embodiments, include any other number of spray assemblies, including two spray assemblies, four spray assemblies or five or more spray assemblies. For instance, in addition to the lower and mid-level spray-arm assemblies 130, 136 and the upper spray assembly 138 (or as an alternative thereto), the dishwashing appliance 100 may include one or more other spray assemblies or wash zones for distributing fluid within wash chamber 106.

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In some such embodiments, input/output ("I/O") signals are routed between the control system and various operational components of dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. The user interface 150 may be in communication with the controller 146 via one or more signal lines or shared communication busses.

Additionally or alternatively, as shown in FIG. 2, a portion of the bottom wall 162 of the tub 104 may be configured as a tub sump portion 152 that is configured to accommodate one or more components of the fluid recirculation assembly 140 (e.g., a filter assembly or other components). It should be appreciated that, in several embodiments, the bottom wall 162 of the tub 104 may be formed as a single, unitary component such that the tub sump portion 152 as well as the surrounding portions of the bottom wall 162 are formed integrally with one another. Alternatively, the tub sump portion 152 may be configured as a separate component configured to be attached to the remaining portion(s) of the bottom wall 162.

Optionally, as shown in FIG. 2, the fluid recirculation assembly 140 may also include a diverter assembly 184 in fluid communication with the pump 142 for diverting fluid between one or more of the spray-arm assemblies 130, 136, 138. For example, the diverter assembly 184 may, in several embodiments, include an inlet 192 coupled to the pump 142 (e.g., via pump conduit 180 shown in FIG. 2) for directing fluid into the diverter assembly 184 and first and second outlets 186, 188 for directing the fluid received from the pump 142 to the lower spray-arm assembly 130 or the mid-level and upper spray-arm assemblies 136, 138, respectively. In some such embodiments, the first outlet 186 may be configured to be directly coupled to the lower spray-arm assembly 130 and the second outlet 188 may be coupled to a suitable fluid conduit 182 of the fluid recirculation assembly 140 for directing fluid to the mid-level and upper spray-arm assemblies 136, 138. Additionally, the diverter assembly 184 may also include a diverter valve 194 to selectively divert the flow of fluid through the assembly 184 to the first outlet 186, the second outlet 188, or the third outlet 190.

It should be appreciated that the present subject matter is not limited to any particular style, model, or configuration of dishwashing appliance. The exemplary embodiments depicted in FIGS. 1 and 2 are simply provided for illustrative purposes only. For example, different locations may be provided for the user interface 150, different configurations may be provided for the racks 120, 122, and other differences may be applied as well.

Figure 3:
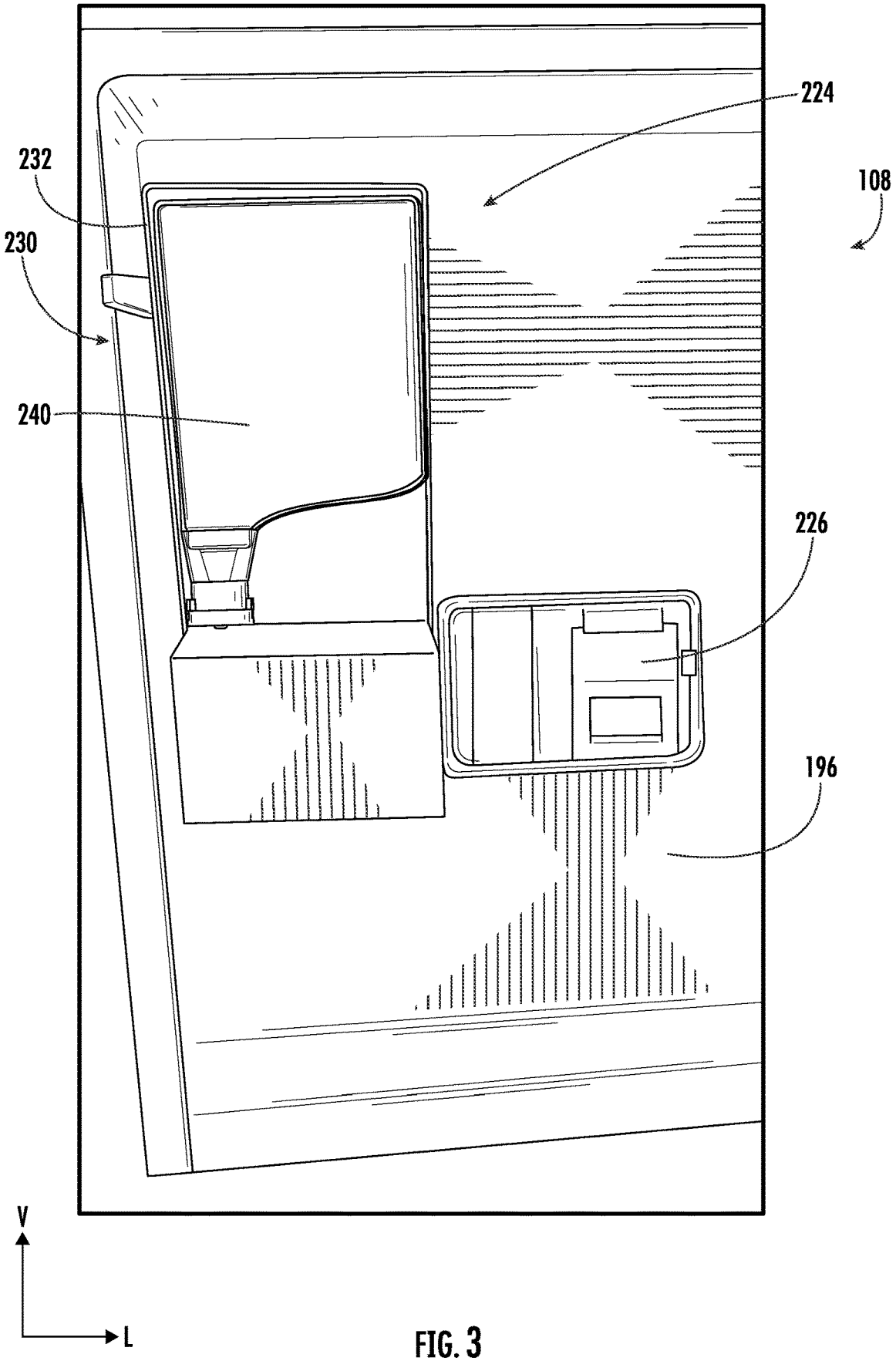
FIG. 3 provides a perspective view of an interior of a door of the exemplary dishwashing appliance of FIG. 1.

Referring now to FIG. 3, an interior of door 108 is shown. For instance, door 108 may include an inner panel 196 and an outer panel 198. It should be understood that as described below, references to the vertical, lateral, and transverse directions (e.g., defined by door 108) are made with respect to the door 108 being in the closed position (e.g., as illustrated in FIG. 2). Moreover, inner panel 196 generally faces wash chamber 106 while outer panel 198 faces the ambient environment. Inner panel 196 and outer panel 198 may be formed of different materials or, alternatively, the same material. In certain embodiments, inner panel 196 is or includes a polymer material (i.e., is formed from a polymer material), such those including poly-propylene. In additional or alternative embodiments, outer panel 198 is or includes a metal or glass material (i.e., is formed from a metal or glass material).

In some embodiments, a dispenser assembly 224 is provided at or on inner panel 196 of door 108 to receive and dispense the wash fluid (e.g., liquid, powder, or pod cleaning agent) to the wash chamber 106. In particular, dispensing assembly 224 may be attached to the inner panel 196 of the door 108. At least a portion of dispenser assembly 224 may include a pocket 226 for accommodating detergent pods or powder detergent. Additionally or alternatively, at least a portion of dispenser assembly 224 may include a box frame 230 for accommodating a bulk dispenser (described in more detail below). Thus, dispensing assembly 224 may be fixed to the door 108 and thereby move with the door 108 (e.g., as it is moved between the open and closed positions). Generally, attachment of dispensing assembly 224 to door 108 will be described in greater detail below.

Box frame 230 may be formed into inner panel 196 of door 108. For instance, a groove or depression may be formed in inner panel 196, into which box frame 230 may be secured. Additionally or alternatively, box frame 230 may be separately attached to a front surface of inner panel 196. Box frame 230 may include a bottle housing 232 and a pump chamber 234 provided adjacent to bottle housing 232. As seen in FIG. 3, bottle housing 232 may be provided above pump chamber 234, e.g., along the vertical direction V. As will be explained further below, bottle housing 232 may accommodate a bottle (e.g., bottle 240) containing detergent (e.g., liquid detergent) which may be selectively fed into pump chamber 234. Accordingly, bottle housing 232 may be referred to as a frame, a holder, a case, a bracket, or any suitable apparatus for retaining a bottle. However, it should be noted that in some embodiments, the bottle housing may be omitted. For instance, the bottle (e.g., bottle 240) may be attached directly to inner panel 196.

Figure 4:
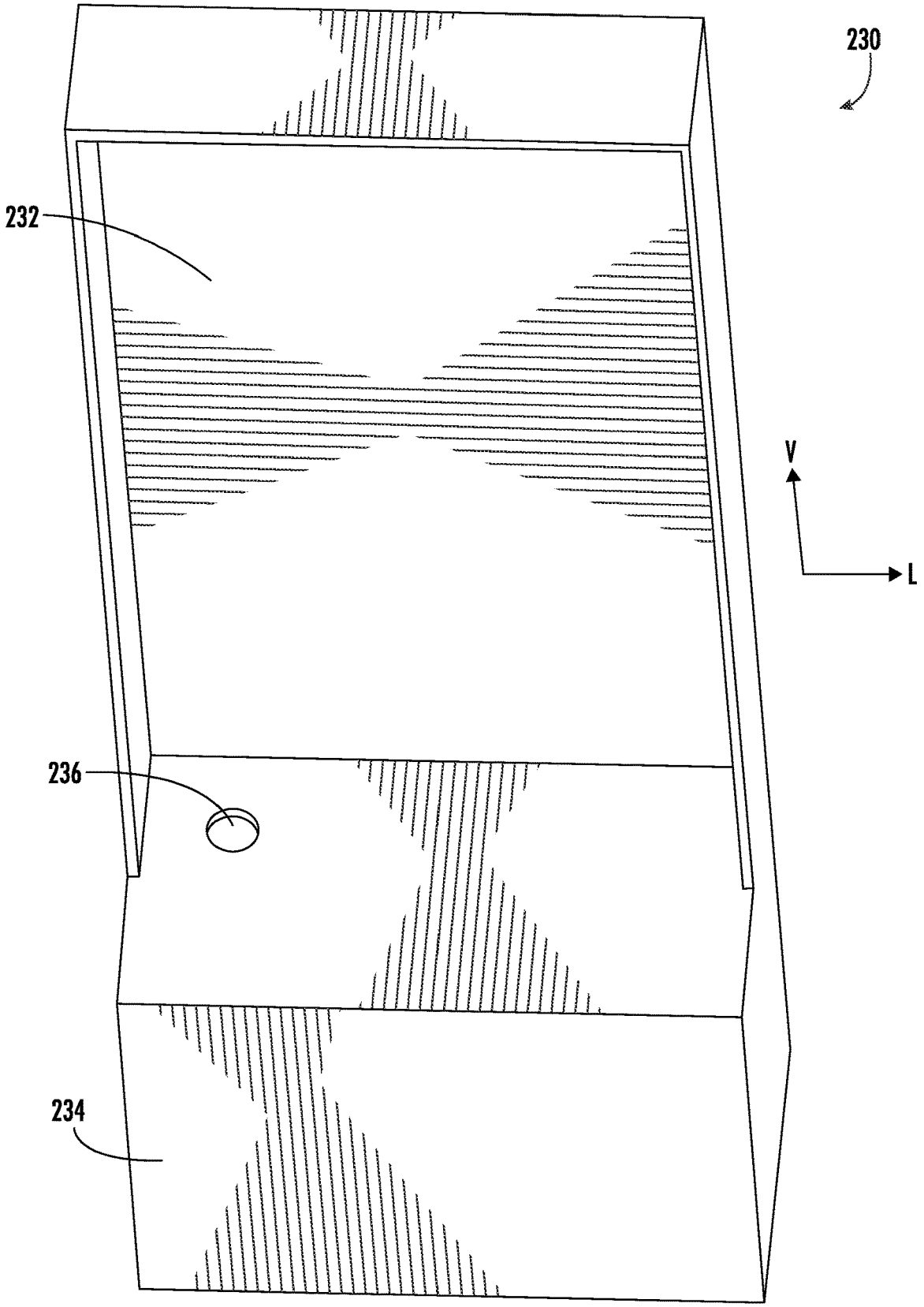
FIG. 4 provides a top perspective view of a door box of the exemplary dishwashing appliance of FIG. 1
Figure 5:
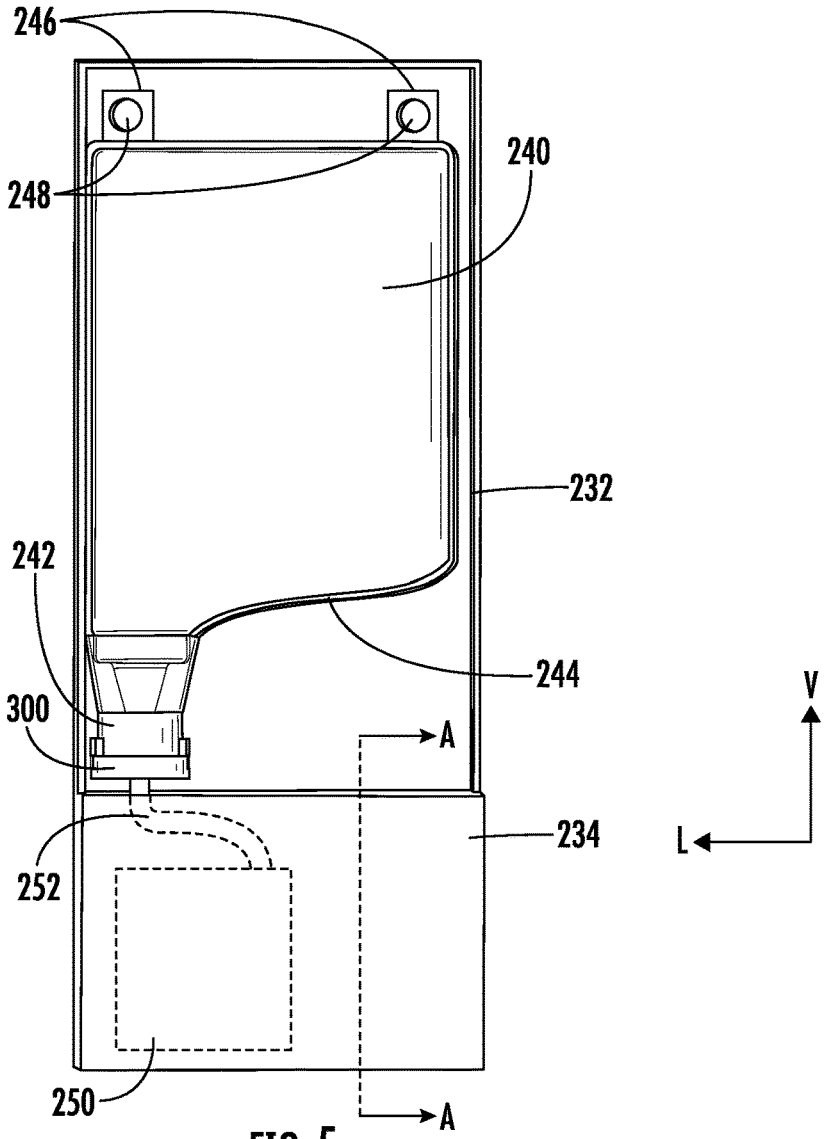
FIG. 5 provides a front view of an exemplary dispensing assembly according to one or more embodiments of the present disclosure.
Figure 6:
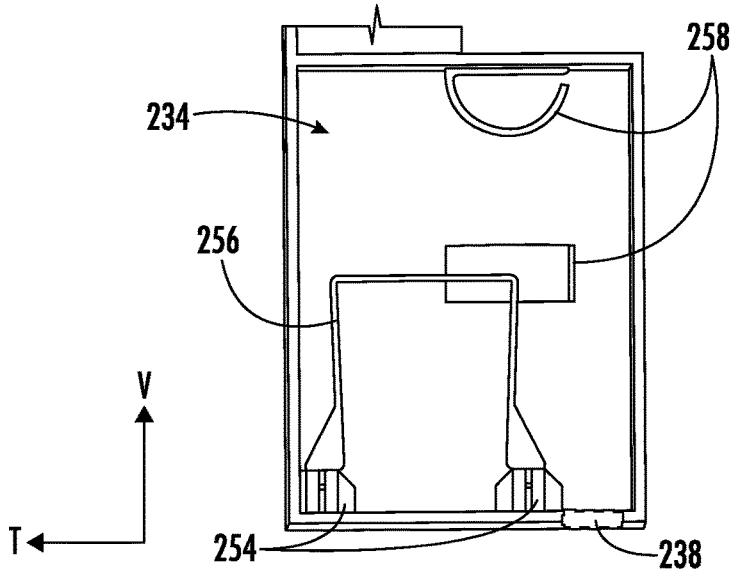
FIG. 6 provides a section view of a pump chamber taken along line A-A of FIG. 5.

Referring now to FIGS. 4 through 6, box frame 230 (and specifically pump chamber 234) will be described in detail. As discussed above, pump chamber 234 may be provided below bottle housing 232 along the vertical direction V. Pump housing 234 may include an inlet hole 236. Inlet hole 236 may be formed through a top surface of pump chamber 234 and allow fluid communication between an interior of pump chamber 234 and an exterior of pump chamber 234, e.g., bottle housing 232 or chamber 106. Inlet hole 236 may have any suitable shape and size so as to allow fluid to enter pump chamber 234. As will be described below, inlet hole 236 may accommodate an adapter.

Pump chamber 234 may further include an outlet hole 238 (FIG. 6). Outlet hole 238 may be formed, for example, through a bottom surface of pump chamber 234. Fluid introduced into pump chamber 234 (e.g., from bottle 240)

may be selectively released through outlet hole 238. Accordingly, outlet hole 238 allows fluid communication between the interior of pump chamber 234 and chamber 106. Thus, according to a selected washing operation, liquid (e.g., liquid detergent from bottle 240) may be released from bottle 240 via pump chamber 234 (e.g., by means of a detergent pump, described below) at predetermined times and in predetermined amounts. Advantageously, a user of the dishwashing appliance 100 may run multiple dishwashing cycles utilizing liquid detergent stored in bottle 240 without having to add detergent (e.g., via pocket 226) for each load.

As shown in FIG. 5, dispenser assembly 224 may accommodate a bottle 240 within bottle housing 232. Bottle 240 may be removably coupled to dispenser assembly 224. For instance, bottle 240 may be removably attached to dispenser assembly 224 via a "poka-yoke" technique. In detail, dispenser assembly 224 may employ an error-proofing or mistake-proofing technique to permit engagement between pieces only in a particular orientation. Accordingly, the use of appropriate detergents may be ensured by allowing only certain specific designs to be attached to dispenser assembly 224. Further description of the attachment process will be described below.

Bottle 240 may include a spout 242 through which liquid within bottle 240 may be dispensed. For instance, spout 242 may be located to one lateral side of bottle 240. Accordingly, when attaching bottle 240 to dispenser assembly 224, bottle 240 may be inserted in a first position before being turned (e.g., approximately 90°) to be secured into place. By locating spout 242 on a lateral side of bottle 240, interference between bottle 240 and bottle housing 232 may be avoided during a turning process between the first position and the second position. A dispensing surface 244 of bottle 240 may be formed adjacent to spout 242. For instance, a bottom surface (e.g., when the bottle is in the installed position, as shown in FIG. 5) of bottle 240 may be ramped toward spout 242. When door 108 is closed, bottle 240 may thus be orientated along the vertical direction V such that gravity draws fluid (e.g., detergent) out of bottle 240 via spout 242. Accordingly, a maximum amount of fluid stored in bottle 240 may be released through spout 242 throughout a predetermined amount of washing cycles.

Bottle 240 may include a plurality of snap tabs 246. As shown in FIG. 5, at least two snap tabs 246 may be provided, however the disclosure is not limited to this and bottle 240 may include more or fewer snap tabs 246 according to specific embodiments. Thus, a single snap tab 246 will be described herein, and it should be understood that the description will apply to each of the plurality of snap tabs 246. In detail, snap tab 246 may extend from bottle 240 opposite spout 242. For instance, when bottle 240 is in the installed position (FIG. 5), spout 242 may extend downward along the vertical direction V and snap tab 246 may extend upward along the vertical direction V. In some embodiments, snap tab 246 may extend along the lateral direction L from bottle 240. Snap tab 246 may be configured to removably attach bottle 240 to dispenser assembly 224 (e.g., to bottle housing 232 or inner panel 196). Snap tab 246 may incorporate any suitable connection means, such as a flexible opening, a snap opening, a magnet, or the like.

Dispenser assembly 224 may further include a plurality of snap protrusions 248 protruding therefrom (e.g., from bottle housing 232 or from inner door 196). As shown in FIG. 5, at least two snap protrusions 248 may be provided, however the disclosure is not limited to this and dispenser assembly 224 may include more or fewer snap protrusions 248 according to specific embodiments. Thus, a single snap protrusion 248 will be described herein, and it should be understood that the description will apply to each of the plurality of snap protrusions 248. Snap protrusion 248 may be complimentary to snap tab 246. In detail, snap protrusion 248 may engage with snap tab 246 to removably couple bottle 240 to dispenser assembly 224. Thus, snap protrusion 248 may incorporate any suitable connection means similar to snap tab 246, such as a flexible pin, a snap pin, a magnet, or the like.

Pump chamber 234 may house a detergent pump 250. Detergent pump 250 may selectively pump fluid (e.g., detergent) from bottle 240 according to certain wash cycle needs of dishwashing appliance 100. Accordingly, detergent pump 250 may be any suitable pump. In at least one embodiment, detergent pump 250 is a peristaltic pump. Detergent pump 250 may be fluidly coupled to bottle 240 via an adapter (described below). In some embodiments, detergent pump 250 is fluidly coupled to bottle 240 via an inlet tube 252. Inlet tube 252 may be a flexible tube or hose through which detergent from bottle 240 is transferred to detergent pump 250. Accordingly, inlet tube 252 may be provided within pump chamber 234 together with detergent pump 250.

Pump chamber 234 may include one or more attachment bosses 254. Attachment bosses 254 may protrude from an interior surface of pump chamber 234. For instance, attachment bosses 254 may protrude along the vertical direction V from a bottom interior surface of pump chamber 234. Attachment bosses 254 may be configured to receive fastening means (e.g., screws, bolts, clips, etc.). Pump chamber 234 may further include a bracket 256. Bracket 256 may hold detergent pump 250 in place within pump chamber 234. Bracket 256 may be removably coupled to attachment bosses 254 (e.g., by screws, bolts, clips, etc.). As shown in FIG. 6, bracket 256 may have a "∩" shape, or an inverted "U" shape, having each leg fastened to a respective attachment boss 254. Thus, detergent pump 250 may be provided under bracket 256.

Pump chamber 234 may include a hose clip 258. In some embodiments, one or more hose clips 258 may be provided. Hose clip 258 may extend from one or more interior walls of pump chamber 234. For instance, a first hose clip 258 may extend from a top interior wall of pump chamber 234 and a second hose clip 258 may extend from a side interior wall of pump chamber 234. Hose clip 258 may support inlet tube 252 to prevent an entangling or kinking of inlet tube 252. Thus, a steady flow of detergent from bottle 240 may be ensured.

Figure 7:
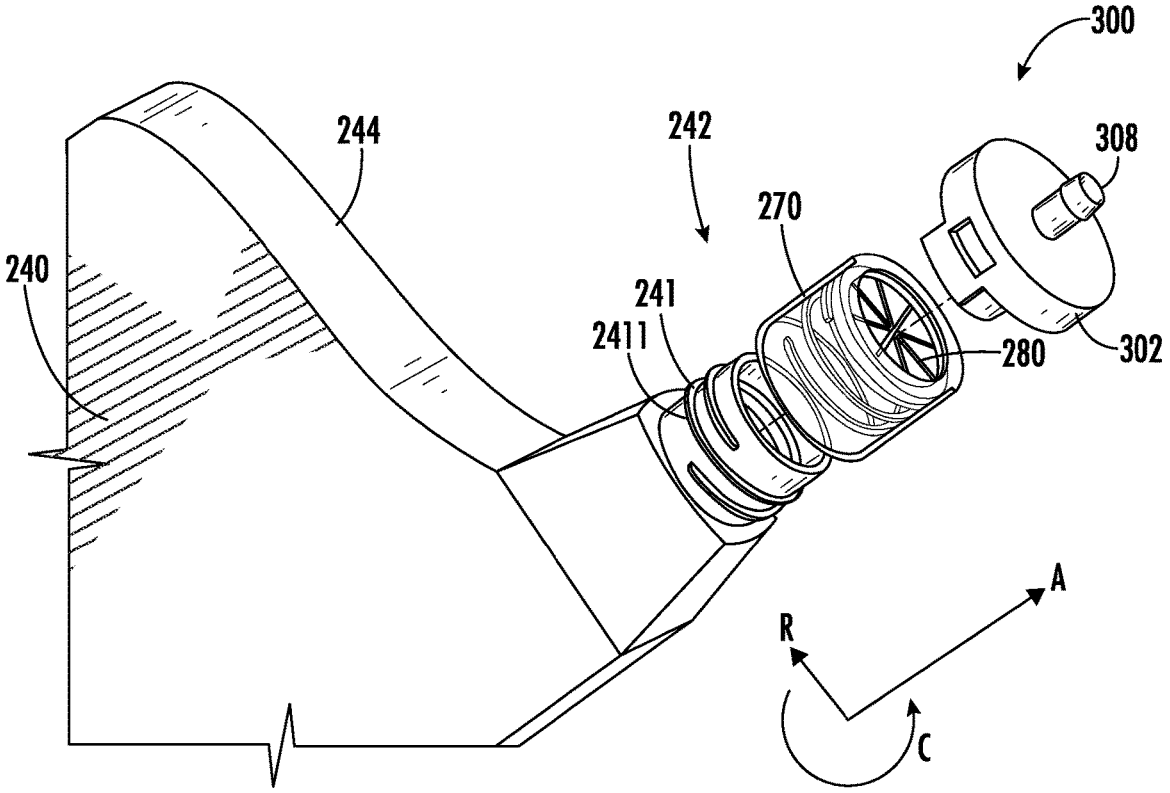
FIG. 7 provides an exploded perspective view of a bottle and cap of the exemplary dispensing assembly of FIG. 5.

Referring to FIG. 7, an embodiment of dispensing assembly including a cap and adapter will be described. As shown in FIG. 7, bottle 240 may include a neck 241. Neck 241 may include an opening through which detergent may flow out of bottle 240. Neck 241 may include an external thread 2411. According to this embodiment, spout 242 includes a cap 270, which will be described in more detail below. According to this embodiment, cap 270 may be threadedly attached to neck 2411 (e.g., via external thread 2411).

Dispenser assembly 224 may include an adapter 300. Hereinafter, reference to dispenser assembly 224 will utilize an axial direction A, a radial direction R, and a circumferential direction C. According to some embodiments, axial direction A may be parallel with the vertical direction V as described above, e.g., when door 108 is in the closed position. Adapter 300 may be coupled or mounted to box frame 230. In some embodiments, adapter 300 is mounted to pump chamber 234. Specifically, adapter 300 may be mounted within inlet hole 236. In still other embodiments, adapter 300 is mounted to door 108. Specifically, adapter 300 may be mounted to inner panel 196. Adapter 300 may provide a connection nexus between bottle 240 and detergent pump 250.

Adapter 300 may include a base 302. Base 302 may be a planar piece being generally disk-shaped. Base 302 may include a first face 304 and a second face 306 opposite first face 304 along the axial direction A. Additionally or alternatively, adapter 300 may include a barb 308. Barb 308 may be a hose barb or nipple, to which a tube or hose (e.g., inlet tube 252) may be attached. Barb 308 may extend from first face 304 of base 302, e.g., along the axial direction A toward pump chamber 234. According to some embodiments, barb 308 is provided at a center of adapter 300 (e.g., a radial center). However, a position of barb 308 on first face 304 may vary according to specific embodiments.

Figure 9:
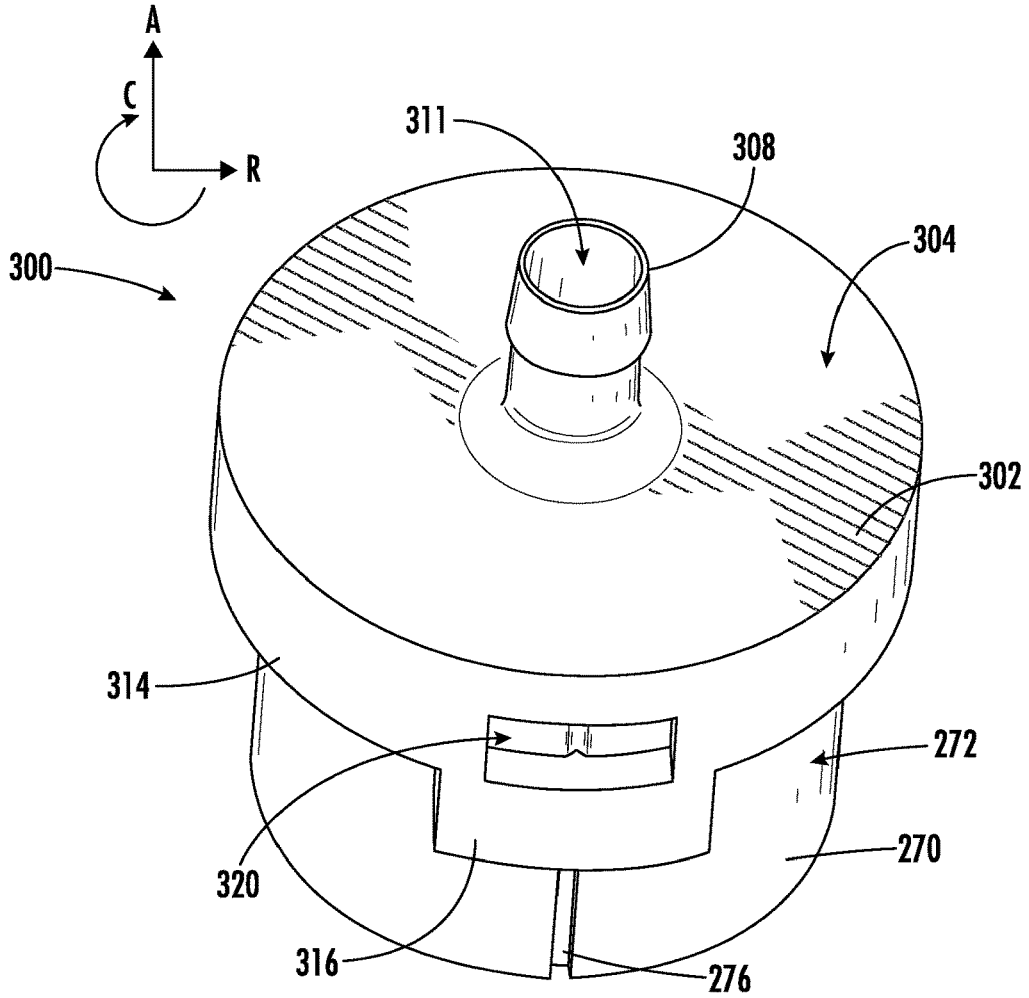
FIG. 9 provides a perspective view of a tunnel piece and cap of the exemplary dispensing assembly of FIG. 5.

As seen particularly in FIG. 5, barb 308 may be positioned within inlet hole 236 of pump chamber 234. For example, base 302 of adapter 300 may be provided above pump chamber 234 (e.g., within bottle housing 232) and barb 308 may penetrate pump housing 234 via inlet hole 236. Thus, at least a portion of barb 308 may be provided within pump chamber 234. Accordingly, inlet tube 252 may be easily received onto barb 308 within pump chamber 234. Referring briefly to FIG. 9, barb 308 may be a standard hose barb featuring a flared section for securely holding inlet tube 252 in place. However, it should be noted that any suitable form of hose connection may be implemented in place of barb 308, and the disclosure is not limited to the hose barb shown and described herein.

Adapter 300 may include an inlet boss 310. Inlet boss 310 may extend from second face 306 of base 302. For instance, inlet boss 310 may extend in a direction opposite barb 308. When door 108 is in the closed position, for example, barb 308 extends downward along the axial direction A and inlet boss 310 extends upward along the axial direction A. Inlet boss 310 may be received within spout 242 of bottle 240. In at least one embodiment, inlet boss 310 protrudes into spout 242 (e.g., neck 241) to allow detergent to flow from bottle 240 through adapter 300 and inlet tube 252 into detergent pump 250.

Figure 10:
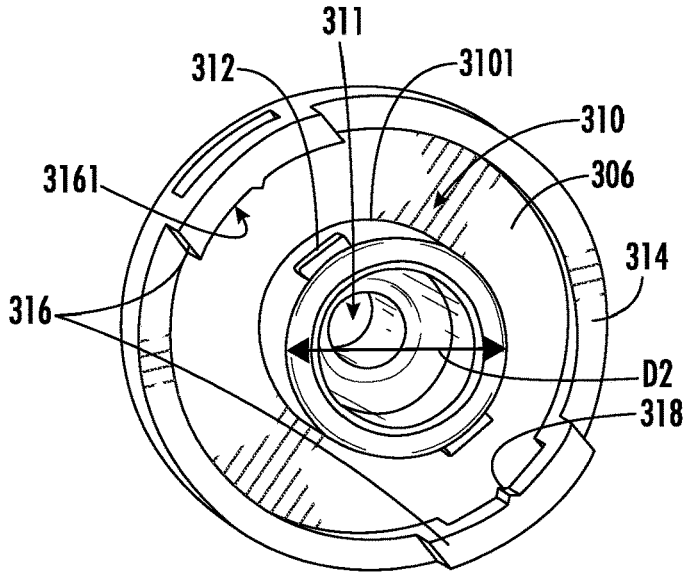
FIG. 10 provides a bottom perspective view of the exemplary tunnel piece of FIG. 9.

As shown in FIG. 10, inlet boss 310 may be a cylinder or cylindrically shaped. In detail, inlet boss 310 may be shaped complementary to spout 242 or neck 241 of bottle 240. Accordingly, a robust connection between adapter 300 and bottle 240 may be ensured. Inlet boss 310 and barb 308 may collectively define a through hole or flow passageway 311 through adapter 300, through which detergent from bottle 240 may flow.

Adapter 300 may include a locking tab 312. Locking tab 312 may extend from inlet boss 310 (e.g., along the radial direction R). For instance, locking tab 312 may extend radially outward from an outer circumferential surface 3101 of inlet boss 310. Locking tab 312 may be provided at a distal end of inlet boss 310 (e.g., distal from second face 306). In some embodiments, a plurality of locking tabs 312 may be provided. For instance, as shown in FIG. 10, two locking tabs 312 may be formed. Locking tab 312 may extend a predetermined distance from inlet boss 310 along the radial direction R. Additionally or alternatively, locking tab 312 may extend a predetermined distance along the circumferential direction C, about inlet boss 310. As will be described below, locking tab 312 may interact with a locking lip formed in spout 242.

Figure 8:
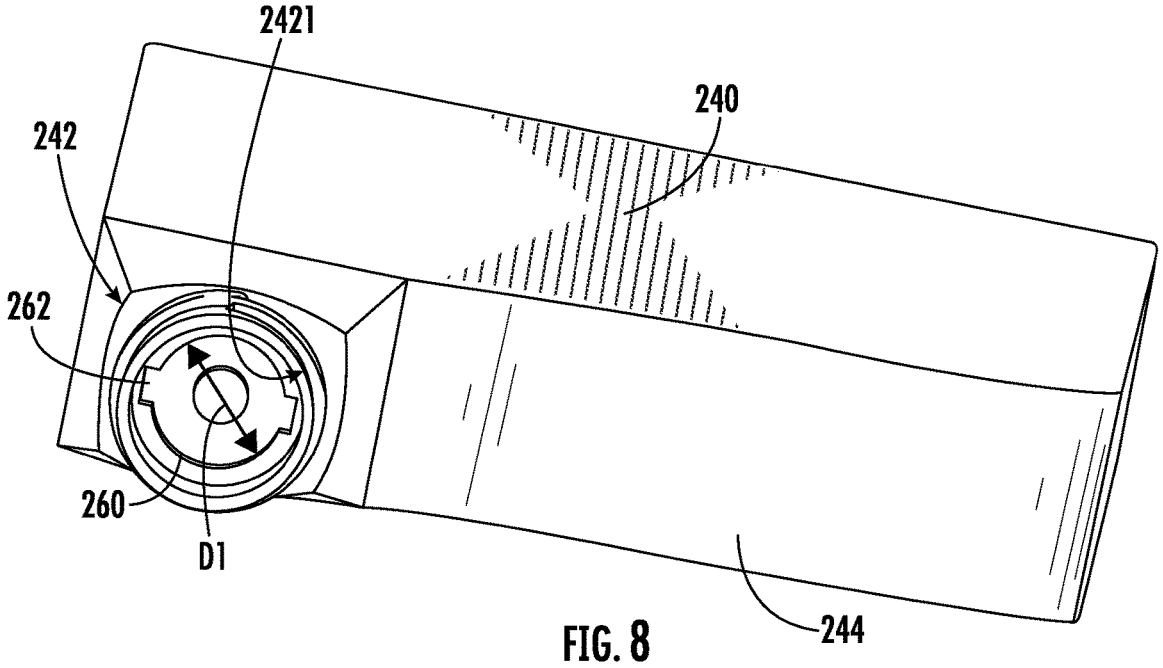
FIG. 8 provides a top perspective view of the bottle of FIG. 7.

Referring briefly to FIG. 8, spout 242 may include a locking lip 260. Locking lip 260 may extend from an inner circumferential surface 2421 of spout 242. Locking lip 260 may be a ring extending along the radial direction R and circumferential direction C. Locking lip 260 may protrude radially inward within spout 242 to restrict access into bottle 240 to certain things such as approved bottle shapes (e.g., employing the "poka-yoke" technique). For instance, an inner diameter D1 of locking lip 260 may be slightly larger than an outer diameter D2 of inlet boss 310. In detail, when inlet boss 310 is inserted into spout 242, a gap may be provided between inlet boss 310 and locking lip 260. Locking lip 260 may further include one or more incisions (e.g., recesses) 262 therethrough.

For instance, incision 262 may be formed axially through locking lip 260. Accordingly, locking tab 312 may pass through incision 262 when bottle 240 is attached to adapter 300. In detail, bottle 240 may be pressed into adapter 300 at a first position. Inlet boss 310 may thus be inserted into spout 242. When in the first position, locking tab 312 may be aligned with incision 262. Upon pressing bottle 240 along the axial direction, locking tab 312 passes through incision 262, accordingly being positioned above (e.g., along the axial direction A) locking lip 260. Bottle 240 may then be twisted (e.g., circumferentially, about 90°) to second position (e.g., as shown in FIG. 5). At this point, because locking tab 312 is no longer aligned with incision 262, locking tab 312 may be restricted from passing through locking lip 260 and bottle 240 may be secured to adapter 300.

Adapter 300 may include a circumferential rim 314. Circumferential rim 314 may extend from second face 306 of base 302, e.g., along the axial direction A. Additionally or alternatively, circumferential rim 314 may extend about a periphery of second face 306, e.g., along the circumferential direction C. Circumferential rim 314 may be sized so as to accept spout 242 therein when bottle 240 is attached to adapter 300.

Adapter 300 may include an extension arm 316. Extension arm 316 may extend from second face 306 of base 302. In some embodiments, extension arm 316 extends from circumferential rim 314. Additionally or alternatively, a plurality of extension arms 316 may be provided. For instance, as shown in FIG. 10. two extension arms 316 are provided, opposite each other about inlet boss 310. Extension arms 316 may be referred to as clips and may assist in securing spout 242 to adapter 300. In detail, extension arms 316 may be concentric with inlet boss 310 such that spout 242 is positioned between inlet boss 310 and extension arms 316 when bottle 240 is attached to adapter 300. Accordingly, extension arms 316 may provide stability and ensure proper connection of bottle 240 (e.g., spout 242) to adapter 300.

A rib 318 may be defined on extension arm 316. In detail, rib 318 may protrude from an interior surface 3161 of extension arm 316. Additionally or alternatively, rib 318 may extend along the axial direction A along interior surface 3161. According to some embodiments, rib 318 extends the entire length of extension arm 316 (e.g., along the axial direction A). Rib 318 may have any suitable shape or form, such as a ridge, a bump, a step, or the like. As will be described further below, rib 318 may interact with spout 242 when bottle 240 is attached to adapter 300. When two or more extension arms 316 are provided, each extension arm 316 may have a rib 318 defined thereon. Accordingly, as shown in FIG. 10, two extension arms 316 and two ribs 318 may be provided.

An aperture 320 may be defined through extension arm 316. In at least one example, aperture 320 is defined through extension arm 316 and circumferential rim 314, e.g., along the radial direction R. Accordingly, a user may see through extension arm 316 to ensure a proper connection between adapter 300 and bottle 240 (e.g., spout 242). Specifically, as will be described below, the user may confirm that rib 318 is properly engaged with spout 242.

Figure 11:
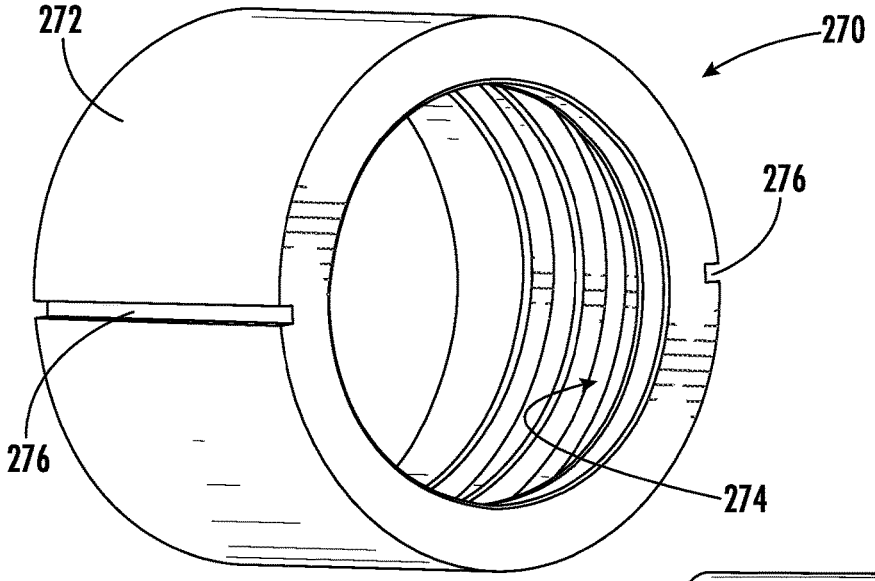
FIG. 11 provides a perspective view of the exemplary cap of FIG. 9.
Figure 12:
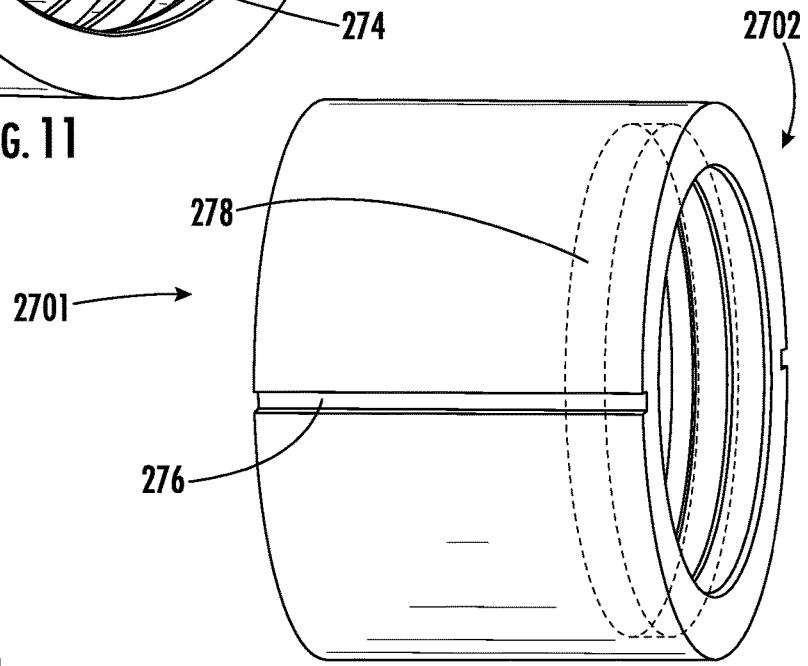
FIG. 12 provides a perspective view showing an interior groove of the exemplary cap of FIG. 11.
Figure 13:
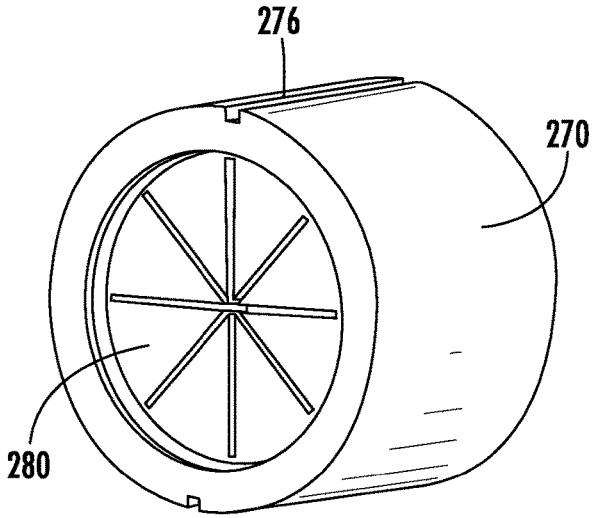
FIG. 13 provides a top perspective view showing a flexible valve of the exemplary cap of FIG. 11.

Referring briefly to FIGS. 11 through 13, spout 242 will be described in detail. According to at least one embodiment, spout 242 is a cap 270. Cap 270 may be threaded onto bottle 240 (e.g., to neck 241 via external thread 2411). Thus, cap 270 may be removably attached to neck 241. Cap 270 may have a cylindrical shape defining an axial through hole. Cap 270 may define an outer circumferential surface 272 and an inner circumferential surface 274. An axial groove 276 may be formed into outer circumferential surface 272. Axial groove 276 may extend from a first axial end 2701 to a second axial end 2702 of cap 270. Additionally or alternatively, axial groove 276 may be parallel with rib 318 of adapter 300.

Axial groove 276 may have a predetermined radial depth. For instance, the radial depth of axial groove 276 may be equal to or greater than a protruding length of rib 318. As discussed above, rib 318 may interact with axial groove 276. In detail, as bottle 240 is pressed axially onto adapter 300 (e.g., in the first position), rib 318 may be circumferentially offset from axial groove 276. When bottle 240 is rotated (e.g., about 90°) rib 318 may be inserted into axial groove 276. According to at least some embodiments, rib 318 thus snaps into place within axial groove 276. Further, a user may visually confirm that rib 318 is in place within axial groove 276 via aperture 320. Additionally or alternatively, extension arm 316 of adapter 300 may be flexible (e.g., in the radial direction R) to allow rib 318 to pass over outer circumferential surface 272 of cap 270 before being inserted into axial groove 276. Moreover, similar to the plurality of extension arms 316, a plurality of axial grooves 276 may be provided. For instance, as shown in FIG. 11, two axial grooves 276 may be provided opposite each other about outer circumferential surface 272 of cap 270. Thus, the number of axial grooves 276 may be equal to the number of extension arms 316 and thus equal to the number of ribs 318.

A circumferential groove 278 may be formed into inner circumferential surface 274 of cap 270. Circumferential groove 278 may have a predetermined radial depth. For instance, circumferential groove 278 may not interfere with axial groove 276. Circumferential groove 278 may be provided at or near second axial end 2702 of cap 270 (e.g., distal bottle 240). Circumferential groove 278 may extend around the entire circumference of cap 270. An axial width of circumferential groove 278 may be a predetermined percentage of the axial length of cap 270. According to some embodiments, the axial width of circumferential groove 278 is between about 5% and about 15% of the axial length of cap 270.

A cap seal 280 may be accommodated within circumferential groove 278. Cap seal 280 may be a flexible seal pressed into circumferential groove 278. For instance, cap seal 280 may be made from a resilient material, such as rubber, silicone, or the like. Cap seal 280 may have one or more slits formed therein. As seen in FIG. 13, cap seal 280 may be pizza-cut to form a plurality of wedge-shapes. Cap seal 280 may prevent liquid (e.g., detergent) within bottle 240 from leaking before bottle 240 is attached to adapter 300.

Moreover, cap seal 280 may interact with inlet boss 310 of adapter 300. In detail, when bottle 240 is attached to adapter 300, inlet boss 310 may deflect cap seal 280. As inlet boss 310 presses against cap seal 280, the wedge shapes formed therein may flare circumferentially outward, allowing inlet boss 310 to enter spout 242 (or neck 241 or cap 270). Thus, liquid (e.g., detergent) from bottle 240 may flow from bottle 240 through adapter 300 and inlet tube 252 to detergent pump 250.

According to this disclosure, a bulk dispense detergent assembly may be provided. A replaceable bottle may be removably attached to an adapter within a wash chamber of a dishwashing appliance. The adapter may employ a "poka-yoke" technique to ensure proper detergents are being used. The adapter may include a hose barb extending from one surface and an inlet boss extending from an opposite surface. The inlet boss may engage with a spout of the bottle and lock into place to provide a secure connection. A pump may selectively urge liquid detergent from the bottle into the wash chamber for washing cycles. The pump may utilize a hose or tube connected to the barb of the adapter. A cap on the bottle may include a flexible seal. The flexible seal may prevent liquid from escaping the bottle before being assembled to the adapter. Thus, an efficient and robust connection system for a bulk dispenser may be provided.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance defining an axial direction, a radial direction, and a circumferential direction, the dishwashing appliance comprising:

a tub defining a wash chamber for receipt of articles for washing;

a door movable between a closed position and an open position; and a dispenser assembly mounted to the door, the dispenser assembly comprising:

an adapter mounted to the door, the adapter comprising an inlet boss configured to engage a spout of a detergent bottle and a discharge barb opposite the inlet boss, wherein the inlet boss is configured to deflect a cap seal of the detergent bottle and wherein the spout defines an axial groove formed into an outer circumferential surface thereof, wherein the adapter comprises:

a base defining a first face and a second face opposite the first face; and an extension arm extending from the second face along the axial direction, the extension arm having an aperture defined therethrough, wherein the extension arm comprises a rib defined on an inner circumferential surface thereof and extending along the axial direction, the rib being selectively received within the axial groove of the spout when the adapter is inserted into the cap seal and rotated 90 degrees; and a pump fluidly coupled to the discharge barb of the adapter for selectively urging a flow of detergent from the detergent bottle.

2. The dishwashing appliance of claim 1, wherein the dispenser assembly further comprises:

a pump chamber housing the pump, the pump chamber defining an inlet hole and an outlet hole, wherein the adapter is provided at the inlet hole.

3. The dishwashing appliance of claim 2, wherein the spout further defines a circumferential groove formed into an inner circumferential surface thereof.

4. The dishwashing appliance of claim 3, wherein the cap seal is a flexible cap seal provided within the spout, and wherein the cap seal is inserted into the circumferential groove.

5. The dishwashing appliance of claim 3, wherein the spout comprises a cap threadedly attached to a neck of the detergent bottle.

6. The dishwashing appliance of claim 3, wherein the discharge barb extends from the first face along the axial direction and the inlet boss extends from the second face along the axial direction and wherein the extension arm is concentric with the inlet boss.

7. The dishwashing appliance of claim 6, wherein the rib is selectively inserted into the axial groove of the spout.

8. The dishwashing appliance of claim 6, wherein the adapter further comprises a locking tab extending from the inlet boss along the radial direction, the locking tab being provided at a distal end of the inlet boss.

9. The dishwashing appliance of claim 8, wherein the dispenser assembly further comprises:

a lip extending from an inner circumferential surface of the spout along the radial and circumferential directions, the lip defining an incision therethrough configured to accept the locking tab.

10. The dishwashing appliance of claim 9, further comprising a snap tab extending from the detergent bottle opposite the spout.

11. The dishwashing appliance of claim 10, further comprising a snap protrusion protruding from the door, wherein the snap tab is configured to removably attach the detergent bottle to the snap protrusion.

12. The dishwashing appliance of claim 6, wherein the discharge barb protrudes into the pump chamber via the inlet hole.

13. The dishwashing appliance of claim 12, wherein the dispenser assembly further comprises:

a hose connecting the pump to the discharge barb.

* * * * *